United States Patent [19]

Abegg

[11] Patent Number: 4,720,927

[45] Date of Patent: Jan. 26, 1988

[54] DEMOUNTABLE SNOWSHOE WITH FLEXIBLE FRAME

[76] Inventor: Sherman T. Abegg, 307 S. 600 West, Layton, Utah 84041

[21] Appl. No.: 937,385

[22] Filed: Dec. 3, 1986

[51] Int. Cl.[4] ..... A63C 13/00

[52] U.S. Cl. ..... 36/122; 36/125

[58] Field of Search ..... 36/122–125, 36/7.5, 7.6

[56] References Cited

U.S. PATENT DOCUMENTS

| | | | |
|---|---|---|---|
| 2,515,070 | 7/1950 | Anderson | 36/7.5 X |
| 3,636,643 | 1/1972 | Lundquist | 36/123 |
| 4,041,621 | 8/1977 | Anderson | 36/122 |
| 4,085,529 | 4/1978 | Merrifield | 36/125 |

FOREIGN PATENT DOCUMENTS

| | | | |
|---|---|---|---|
| 2477025 | 9/1981 | France | 36/122 |

*Primary Examiner*—James Kee Chi

*Attorney, Agent, or Firm*—J. Winslow Young

[57] ABSTRACT

A snowshoe having a flexible framework demountably engaged in a fabric shell. The individual elements of the framework are rigid but are releasably joined together through rotatable joints so as to provide the flexible framework. The fabric shell forms the deck for the snowshoe and holds the various rigid elements together into the flexible framework. A shoe clamp on the top surface of the fabric deck is mounted to a cleat on the bottom surface of the fabric deck.

21 Claims, 4 Drawing Figures

DEMOUNTABLE SNOWSHOE WITH FLEXIBLE FRAME

BACKGROUND

1. Field of the Invention

This invention relates to snowshoes and, more particularly, to a demountable snowshoe with a flexible frame, the flexible frame being releasably mounted to a fabric deck.

2. The Prior Art

Snowshoes have been known for centuries and are designed to distribute the weight of a wearer over an extended surface to enable the wearer to walk across deep snow without sinking into the snow. Historically, snowshoes are fabricated with a wooden, essentially rigid, framework with a webbing of leather straps mounted across the framework. The webbing provides the necessary increased surface area over which the weight of the wearer is distributed. The shoe of the wearer is tied to the snowshoe in such a manner as to allow the wearer's foot to pivot forward while leaving the body of the snowshoe in a plane generally parallel to the surface of the snow. The forward end of the snowshoe is curved upwardly and is lifted forward with each step. The rear of the snowshoe is formed into an elongated extension of the frame to serve as a rudder which, upon being dragged through the snow acts in a rudder-like manner, keeping the snowshoe generally aligned in the direction of travel.

This type of snowshoe is quite heavy and awkward. It also requires a substantial degree of skill from the wearer. Subsequent modifications of snowshoe include the use of lightweight frames fabricated from aluminum. The webbing or decking material is provided from various types of mesh fabrics such as nylon and the like. One model is even configurated with a framework which can be disconnected near the shoe securement so as to provide a foldable snowshoe.

Travel using snowshoes involves traverse over various types of snow and ice conditions as well as rocks, tree limbs, steep slopes, and the like. The stiff framework of the presently available snowshoes creates a difficult platform for the wearer if the edge of the snowshoe hits a rock or tree limb causing the stiff snowshoe to twist relative to the foot of the wearer. Further, such encounters severely abrade the frame and webbing of the snowshoe. Ice also represents an even further difficulty since the snowshoe does not have any suitable mechanism for gripping the ice particularly on a sloping surface.

In view of the foregoing, it would be an advancement in the art to provide a novel snowshoe which incorporates a flexible framwork to adapt the snowshoe to travel across uneven terrain without twisting the foot or leg of the wearer. Another advancement would be to include a cleat mechanism secured to the snowshoe under the foot of the wearer so as to permit the wearer to safely traverse areas of ice with minimal abrasion of the framework or webbing material of the snowshoe. An even further advancement would be to provide a snowshoe that can be readily disassembled into a compact configuration and easily assembled by the wearer. Such a novel snowshoe apparatus and method is disclosed and claimed herein.

BRIEF SUMMARY AND OBJECTS OF THE INVENTION

This invention relates to a novel snowshoe having a flexible framework and a woven fabric deck. A shoe mount is secured to the upper surface of the fabric deck by being mounted to a cleat device on the bottom surface of the fabric deck. The framework is prepared from rigid elements joined in joints that are relatively freely rotatable so as to provide the desired degree of flexibility to the overall framework. The fabric deck material holds the various rigid elements together into the flexible framework so that removal of the flexible framework from the fabric deck allows the user to easily disassemble the framework into a substantially smaller package. The cleat provides the wearer with an ince engagement means as well as surface upon which the wearer steps when encountering other objects such as tree limbs, rocks, and the like.

It is, therefore, a primary object of this invention to provide improvements in snowshoes.

Another object of this invention is to provide a flexible framework for a snowshoe.

Another object is to provide a flexible framework prepared from a plurality of rigid elements joined into the flexible framework through freely rotatable joints between the rigid elements.

Another object is to provide a fabric deck for the snowshoe wherein the fabric deck holds the plurality of rigid elements together into the flexible framework.

Another object is to provide a cleat attached to the bottom of the snowshoe.

These and other objects and features of the present invention will become more fully apparent from the following description and accompanying drawing taken in conjunction with the appended claims.

DETAILED DESCRIPTION

The invention is best understood by reference to the following detailed description with reference to the accompanying drawing wherein like parts are designated with like numerals throughout.

Figure 1:
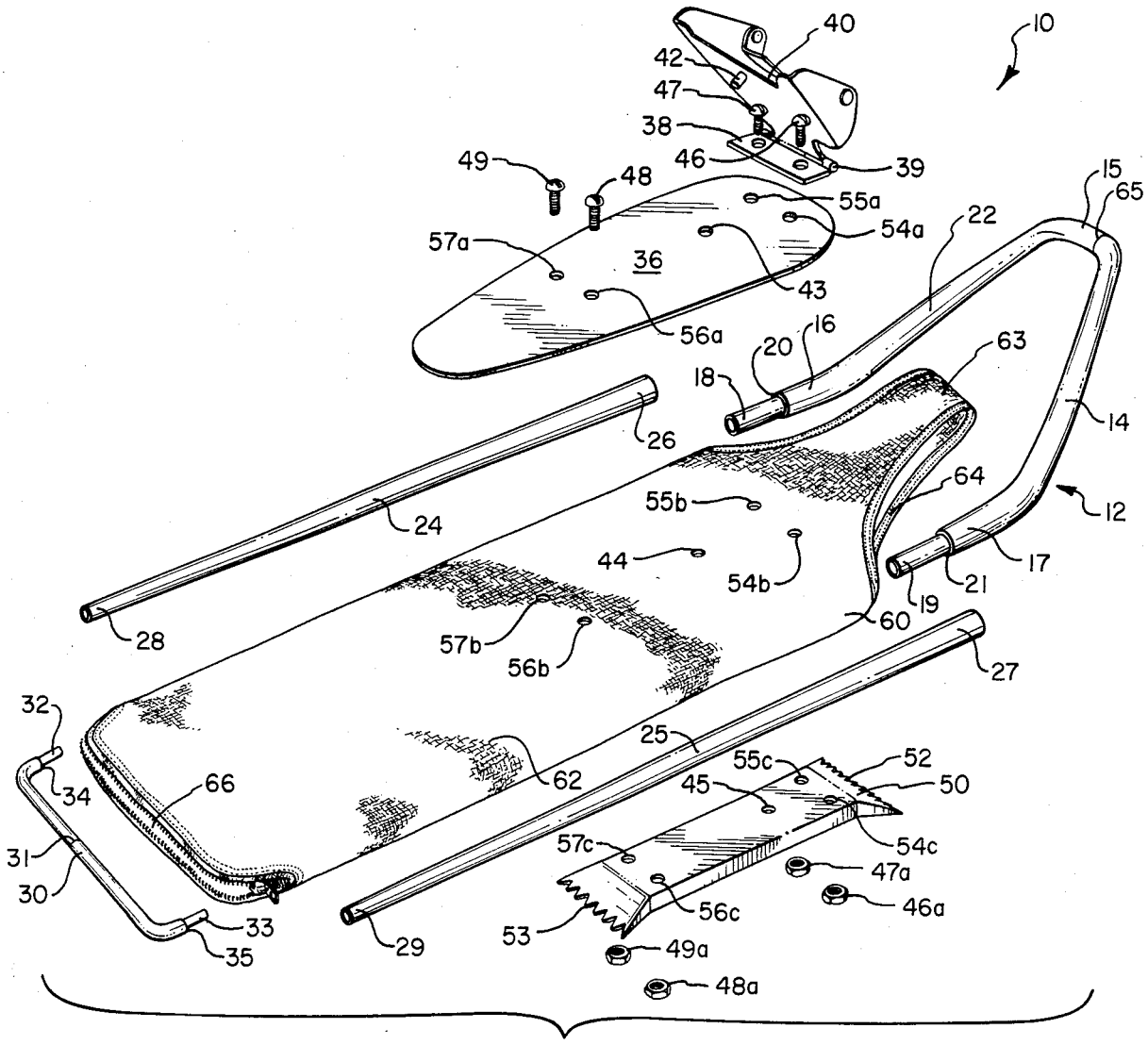
FIG. 1 is an exploded, perspective view of a snowshoe of this invention.
Figure 2:
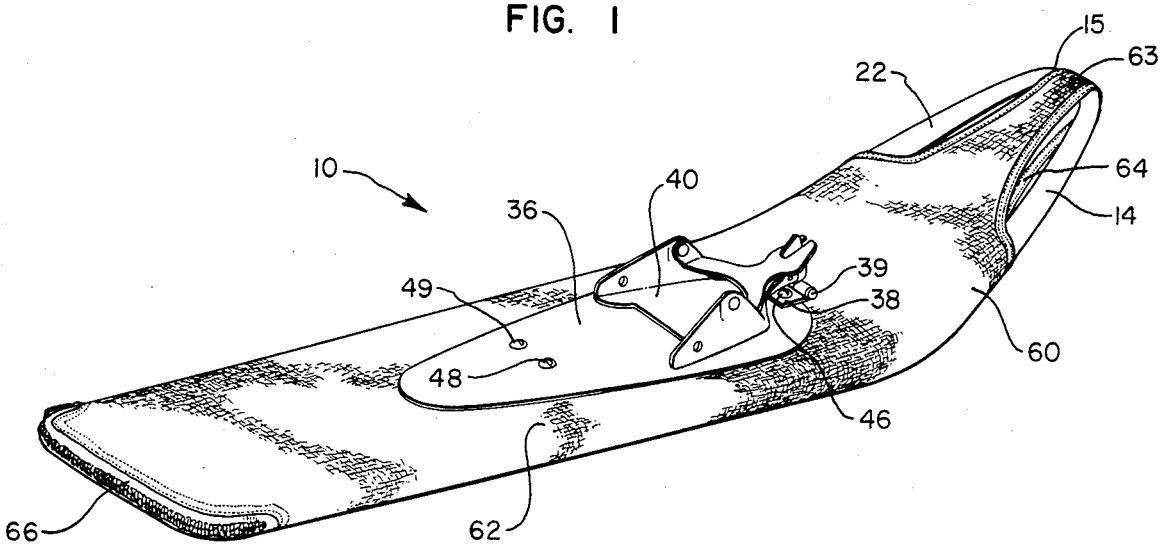
FIG. 2 is a perspective view of the snowshoe of FIG. 1 in the assembled condition.
Figure 3:
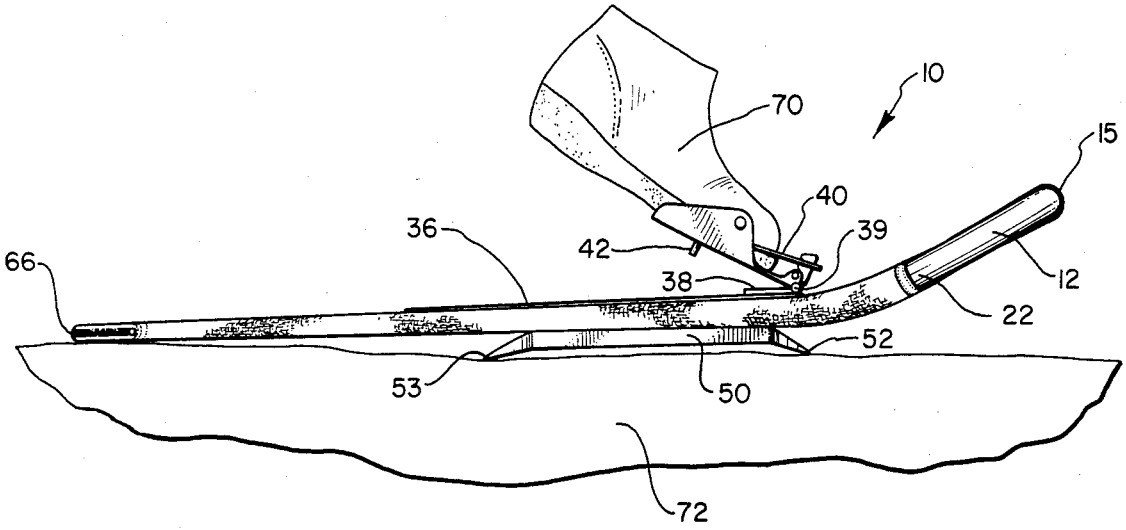
FIG. 3 is a side elevation of the snowshoe of FIG. 1 shown in an assembled configuration.

Referring now more particularly to FIGS. 1–3, the novel snowshoe of this invention is shown generally at 10 and includes a flexible framework 12 inserted inside a fabric shell 60 which forms a deck 62. A shoe clamp 40 is affixed to the upper surface of deck 62 against a cleat 50 mounted on the bottom surface of deck 62. Framework 12 includes a toe piece 14 having an upwardly bent section 22 which raises the forward end or nose 15 of toe piece 14 above the snow 72 (FIG. 3). A pair of arms 16 and 17 (FIG. 1) extends outwardly from the respective ends of toe piece 14 and support joint segments 18 and 19, respectively. A bushing 20 resides between joint segment 18 and arm 16 while a corresponding bushing 21 resides between joint segment 19 and arm 17.

A first rail 24 and a second rail 25 form the sides of framework 12. Rails 24 and 25 are formed with a uniform rearwardly extending taper and include forward sockets 26 and 27, respectively, for engagement with joint segments 18 and 19, respectively. The joints formed thereby are specifically intended to be relatively loose fitting so as to allow an essentially nonbinding rotational movement of rails 24 and 25 relative to the toe piece 14 as with respect to the corresponding arms 16 and 17.

Similar nonbinding joints are provided between heel piece 30 and ends 28 and 29 of rails 24 and 25. In particular, heel piece 30 includes forward facing fingers 32 and 33 which are telescopically received in ends 28 and 29 of rails 24 and 25, respectively, in an essentially nonbinding relationship. End 28 abuts a bushing 34 while end 29 abuts a bushing 35 to protect heel piece 30 against abrasion during the foregoing rotational movement. This characteristic of nonbinding rotational movement is an important feature of this invention since it allows framework 12 to flex relatively freely, the importance of which will be discussed more fully hereinafter.

The assembled, flexible framework 12 is enclosed within a woven fabric shell 60 with a heel piece 30 inside heel 66. The front 63 of deck 62 extends across nose 15 of toe piece 14 through a cutout 64. Rails 24 and 25 provide the necessary side elements for framework 12 of snowshoe 10 and stretch fabric shell 60 outwardly to create the deck 62. Rails 24 and 25 also provide the longitudinal stretching of deck 62 between nose 15 and heel piece 30. Accordingly, fabric shell 60 provides the constrictive support around flexible framework 12 to keep the various, flexible joints therein from separating while at the same time allowing the flexible joints to rotate relatively freely to impart the desired degree of flexibility to framework 12. A zipper is shown across the end of fabric shell 60 although its presence may be eliminated without unduly affecting the operational features of snowshoe 10.

Figure 4:
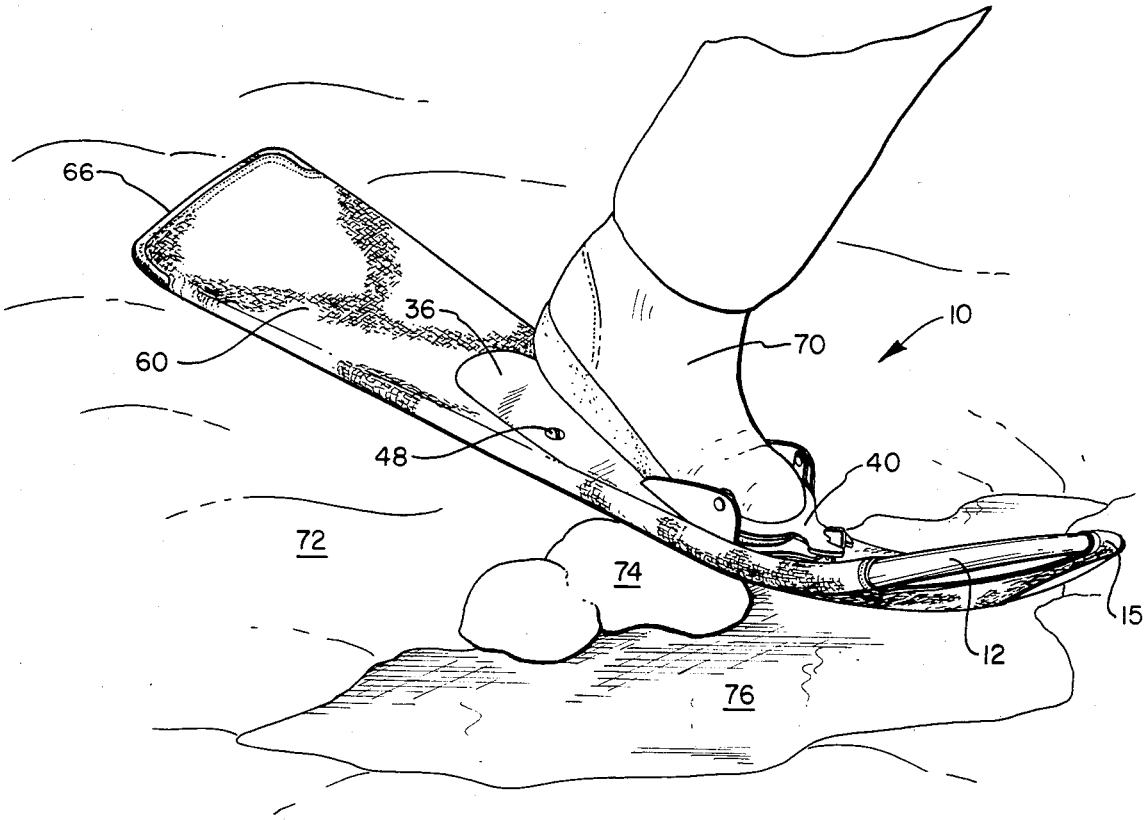
FIG. 4 is a perspective view of the snowshoe of this invention shown in the environment of snow, ice, and rocks.

A foot piece 36 with an attached shoe clamp 40 is mounted to deck 62 by being secured to a cleat 50 mounted on the bottom surface of deck 62. Both fabric layers of deck 62 are clamped between foot piece 36 and cleat 50. Foot piece 36 is fabricated from any suitable material such as plastic and is primarily designed to reduce abrasion of fabric 60 by shoe 70 (FIGS. 3 and 4). Foot piece 36 along with shoe clamp 40 is secured to cleat 50 by bolts 46–49 which pass through the respective holes **54*abc*–57*abc*, and are secured by the respective lock nuts 46*a*–49*a***.

Shoe clamp 40 may be any suitable shoe clamping device such as a conventional shoe clamp similar to those used on cross country skis. In the illustrated embodiment the toe of the shoe 70 (FIG. 3 and 4) is securely clamped therein. A hinge 39 connects shoe clamp 40 to an anchor plate 38. Anchor plate 38 is the mechanism which securely anchors shoe clamp 40 to snowshoe 10 or, more particularly, cleat 50. The pivotal function of hinge 39 allows the wearer (not shown) of snowshoe 10 to flex shoe 70 (FIGS. 3 and 4) forward in a plane generally perpendicular to the plane of deck 62 and parallel to the axis of snowshoe 10. This allows the wearer to walk forward in a natural manner while retaining the snowshoe 10 in an orientation with the forward end, as represented by nose 15 (see FIG. 3), held above snow 72 while heel 66 is lightly dragged across the surface of snow 72. The relatively light weight of snowshoe 10 and the function of hinge 39 combine to provide snowshoe 10 with a high degree of trailing stability. This means that the user (not shown) can use snowshoe 10 easily in a natural manner without the cumbersome trailing devices used in the conventional wood and leather snowshoes.

Cleat 50 is fabricated from a light weight metal such as aluminum and is configured as a section of channel with downwardly extending sides. The ends of the sides and ends 52 and 53 are flared downwardly and outwardly to form ice crampons, the utility of which is augmented by the serrations therein. Cleat 50 is directly under foot piece 36 so that the wearer (not shown) can step directly on a rock 74 (FIG. 4) with cleat 50 or ice 76 (FIG. 4) and the weight of the wearer is supported directly on cleat 50 rather than by the body of snowshoe 10. This feature is advantageous since it protects fabric shell 60 and framework 12 against excessive abrasion. Further, cleat 50 securely engages ice 76 for the safety of the wearer. This is especially important when encountering patches of hidden ice particularly on steep slopes.

The wearer (not shown) places the toe of shoe 70 (FIGS. 3 and 4) in shoe clamp 40 to secure snowshoe 10 to shoe 70. Advantageously, shoe 70 can be any suitable shoe and even a shoe specially modified as a cross country ski shoe with shoe clamp 40 being obtained from the type of shoe clamp customarily attached to cross-country skis. A peg 42 (FIGS. 1 and 3) is included as part of shoe clamp 40 and serves as an interlock into hole 45 in cleat 50 to reduce stresses such as side loads on hinge 39. Peg 42 passes downwardly through hole 43 in shoe plate 36 and hole 44 in deck 62 to engagement with hole 45 in cleat 50. This feature is useful due to the twisting forces imposed upon shoe clamp 40 and shoe 70 during traverse of uneven terrain and obstacles such as rocks 74 and ice 76 (FIG. 4). Peg 42 not only reduces stress on hinge 39 but also keeps shoe clamp 40 in alignment with the axis of snowshoe 10.

Fabric shell 60 is shown as having a double layer of fabric for deck 62. Fabric shell 60 is formed as a tube with a closed end at heel 66 and a nose piece 63 formed from a cutout 64 at the forward end. This tube configuration provides an open chamber into which framework 12 is assembled so that the dimensional characteristics of fabric shell 60 serve to hold framework 12 together. Alternatively, individual sleeves could be formed along each side of deck 62 to receive each of rails 24 and 25. A separate sleeve would then be formed at heel 66 for heel piece 30. While this latter embodiment could be advantageous toward reducing the amount of fabric in fabric shell 60 required for deck 62, the illustrated double thickness has the advantage in that if the bottom layer becomes torn, it can be mended easily by sewing it directly to the upper, undamaged layer.

Snowshoe 10 is easily disassembled by stretching aside nose piece 63 by cutout 64 from nose 15 and removing toe piece 14 by disengaging joint segments 18 and 19 from rails 24 and 25, respectively. Rails 24 and 25 are then pulled from the interior of fabric shell 60 upon disconnection from heel piece 30. Heel piece 30 may be left inside fabric shell 60. Fabric shell 60 with shoe plate 36 and cleat 50 along with shoe clamp 40 can be folded into a relatively compact bundle around rails 24 and 25 and toe piece 14. Toe piece 14 can also be disassembled into arms 16 and 17 by release of a joint 65 (FIG. 1) in nose 15. Heel piece 30 can also be disassembled at joint 31 (FIG. 1) if desired. This feature provides a unique snowshoe 10 that is easily transportable, for example, in the backpack of a crosscountry skier, snowmobile or even in an emergency pack in an aircraft or rescue vehicle.

To assemble, the user merely unfolds fabric shell 60 and aligns heel piece 30 inside heel 66 after which rails 24 and 25 are inserted into engagement with fingers 32 and 33, respectively. Toe piece 14 is then assembled at joint 65 (FIG. 1) and engaged with rails 24 and 25 through joint segments 18 and 19, respectively, to complete framework 12. Nose piece 63 is then slipped over nose 15 to encapsulate framework 12 inside fabric shell 60. The relatively loose, freely rotatable joints make assembly and disassembly of framework 12 and its insertion into and removal from fabric shell 60 a fairly simple task. Advantageously, fabric shell 60 sustains the structural integrity of flexible framework 12 while the loose joints in combination with the flexibility of fabric shell 60 allows framework 12 to flex or otherwise twist when encountering rocks 74 or ice 76 as best seen in FIG. 4.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A snowshoe comprising:

a flexible framework comprising;

a plurality of rigid elements; and a plurality of rotatable joints interconnecting said rigid elements into said flexible framework:

a fabric deck mounted to said flexible framework, said fabric deck holding said rigid elements together into said flexible framework, said fabric deck allowing said flexible framework to be flexible through rotation of said rotatable joints; and a shoe securing means for releasably securing a shoe to said fabric deck.

2. The snowshoe defined in claim 1 wherein said rigid elements of said flexible framework comprises:

a forward toe piece, a rearward heel piece and first and second rail members extending between said tow piece and said heel piece, said first rail member forming part of said flexible framework on a first side of said shoe securing means and said second rail member forming part of said flexible framework on a second side of said shoe securing means.

3. The snowshoe defined in claim 2 wherein said rotatable joints of said flexible framework comprises:

a first, rotatable joint between a first side of said toe piece and a first end of said first rail member, a second, rotatable joint between a second side of said toe piece and a first end of said second rail member, a third, rotatable joint between a first side of said heel piece and a second end of said first rail member, and a fourth, rotatable joint between a second side of said heel pice and a second end of said second rail member.

4. The snowshoe defined in claim 3 wherein said first, second, third, and fourth rotatable joints are formed from a first size of tubular stock and a second size of tubular stock, said first size of tubular stock being selectively predetermined to telescopically receive said second size of tubular stock in loose fitting relationship.

5. The snowshoe defined in claim 4 wherein said second size of tubular stock is provided as an insert securely engaged in a third size of tubular stock with a bushing inserted between said first size of tubular stock and said third size of tubular stock when said first size of tubular stock is telescopically mounted over said second size of tubular stock into abutment with said third size of tubular stock.

6. The snowshoe defined in claim 5 wherein said first size of tubular stock is essentially identical to said third size of tubular stock and said bushing provides secure engagement of said second size of tubular stock in said first size of tubular stock.

7. The snowshoe defined in claim 2 wherein said forward toe piece is demountable into at least tow toe elements through a first joint.

8. The snowshoe defined in claim 2 wherein said heel piece is demountable into at least two heel element through a second joint.

9. The snowshoe defined in claim 1 wherein said fabric deck comprises a layer of fabric mesh having framework receiving means formed therein.

10. The snowshoe defined in claim 9 wherein said fabric deck comprises a tubular element and said flexible framework is inserted into said tubular element.

11. The snowshoe defined in claim 9 wherein said fabric deck includes means for removing said flexible framework from said fabric deck.

12. The snowshoe defined in claim 1 wherein said shoe securing means comprises a clamping means for clamping at least a portion of said shoe.

13. The snowshoe defined in claim 1 wherein said shoe securing means includes a cleat mounted on the bottom surface of said fabric deck with said shoe securing means attached to said cleat.

14. The snowshoe defined in claim 13 wherein said cleat includes a plurality of downwardly extending ridges around a portion of the periphery of said cleat.

15. A snowshoe comprising:

a unitary, fabric deck;

a flexible framework removably mounted to said fabric deck, said flexible framework comprising:

a plurality of rigid elements and a plurality of rotatable joints interconnecting said rigid elements to form said flexible framework;

a shoe mount secured to a top surface of said fabric deck, said shoe mount releasably securing a shoe to said snowshoe; and a cleat mounted to said shoe mount on a bottom surface of said fabric deck.

16. The snowshoe defined in claim 15 wherein said fabric deck is fabricated as a tubular element with said flexible framework being telescopically received inside said tubular element in snug fitting relationship, said tubular element holding said rigid elements together into said flexible framework for said fabric deck.

17. The snowshoe defined in claim 15 wherein said shoe mount is hingedly secured to said cleat to permit forward rotation of a shoe secured in said shoe mount with said shoe resting against said cleat when not rotated forwardly.

18. The snowshoe defined in claim 17 wherein said shoe mount includes a pin for releasably engaging said shoe mount to said cleat when said shoe is resting against said cleat.

19. The snowshoe defined in claim 15 wherein said cleat comprises a plurality of peripheral, downwardly extending ridges and said cleat generally corresponds to the outline of a shoe secured in said shoe mount.

20. A method for providing a snowshoe with a demountable, flexible framework comprising:

preparing a toe piece for said snowshoe, said toe piece comprising an elongated member shaped into a generally U-shaped configuration with an arm oriented along each side of said snowshoe;

obtaining a pair of rails for the sides of said snowshoe;

joining the ends of said rails to said arms in relatively loose fitting joints thereby forming sides to said snowshoe with said rails in spaced relationship;

mounting a heel piece to the free ends of said rails;

forming loose fitting joints between said heel piece and said free ends of said rails to complete forming said demountable, flexible framework;

flexibly securing said framework together by enclosing said framework with a fabric deck for said snowshoe; and mounting a shoe clamp to an upper surface of said fabric deck.

21. The method defined in claim 20 wherein said mounting step includes preparing a cleat for the bottom surface of said fabric deck and securing said shoe clamp to said cleat.

* * * * *